US005416930A

United States Patent [19]

Waldner et al.

[11] Patent Number: 5,416,930

[45] Date of Patent: May 23, 1995

[54] AIR CLEANING DEVICE FOR A TOILET BOWL

[75] Inventors: Samuel Waldner, Decker; Amos Waldner, Lac du Bonnet, both of Canada

[73] Assignee: Rein Pure Air Inc., Lac du Bonnet, Canada

[21] Appl. No.: 184,149

[22] Filed: Jan. 21, 1994

[51] Int. Cl.[6] ..... E03D 9/052

[52] U.S. Cl. ..... 4/213

[58] Field of Search ..... 4/213

[56] References Cited

U.S. PATENT DOCUMENTS

| | | | |
|---|---|---|---|
| 1,798,457 | 3/1931 | Cole | 4/213 |
| 2,001,593 | 5/1935 | Teetor | 4/213 |
| 3,230,551 | 1/1966 | Kopp | 4/213 |
| 3,849,808 | 11/1974 | Olson et al. | 4/213 |
| 4,085,470 | 4/1978 | Roberts | 4/213 |
| 4,317,242 | 3/1982 | Stampes | 4/213 |

*Primary Examiner*—Robert M. Fetsuga

*Attorney, Agent, or Firm*—Adrian D. Battison; Stanley G. Ade; Murray E. Thrift

[57] ABSTRACT

An air cleaning device for attachment to a toilet bowl comprises a bracket mounted on the bolts behind the toilet seat and extending outwardly to one side. At the end of a bracket is mounted a cradle into which a housing is mounted including a fan housing and a filter assembly. The filter assembly is carried on the underside of the fan housing and includes a cage having a closed base wall and a plurality of vertical bars for the air enters the interior of the cage and escapes horizontally through the bars. A sleeve-shaped filter element is mounted over the bars and sits on the horizontal base. Vertical power supplied by a battery pack which can slide in and out of a receptacle on the top cover of the housing. The housing includes a nozzle which can slide in and out of a receptacle in the housing, the nozzle being formed in the shape of a flat tube so as to extend over the toilet bowl.

10 Claims, 4 Drawing Sheets

AIR CLEANING DEVICE FOR A TOILET BOWL

This invention relates to an air cleaning device for mounting on a toilet bowl for extracting air from the environment of the toilet bowl and for filtering from the air undesirable smells.

BACKGROUND OF THE INVENTION

Many proposal have previously been made for suction air cleaning devices for mounting on or adjacent a toilet bowl for the purpose of cleaning the air. Very many different designs have been proposed but none has been effectively commercially successful leading to a suitable device which can be manufactured and sold at a suitable price and simply mounted on the toilet bowl without necessity for complex assembly or plumbing installations.

SUMMARY OF THE INVENTION

It is one object of the present invention, therefore, to provide an improved air cleaning device of this type.

According to the present invention, therefore, there is provided an air cleaning device for mounting on a toilet bowl having a bowl opening, a bowl rim and a seat mounting on the rim rearwardly of the opening, the device comprising a bracket having a first portion arranged for mounting on the toilet bowl at the seat mounting, a second cradle portion projecting from the first portion outwardly to one side of the bowl, a housing mounted on the cradle portion so as to be located to one side of the rim and defining a front face facing toward the rim and a lower surface facing downwardly toward the floor, a fan mounted in the housing, a first horizontal elongate inlet opening in the front face of the housing, a second outlet opening in the lower surface, a flat nozzle member removably mounted on the housing at the first inlet opening and extending therefrom to form an open slot shaped mouth for projecting over the rim and under the seat, a filter support cage mounted on the housing at the second outlet opening and extending downwardly therefrom to define a plurality of vertical bars defining a cylindrical outer surface and a hollow interior, a sleeve shaped flexible filter member engaged over the support cage, the housing and fan being arranged such that air drawn by the fan into the mouth of the nozzle is expelled from the housing into the hollow interior of the cage and through the filter member.

One embodiment of the invention will now be described in conjunction with the accompanying drawings in which:

DETAILED DESCRIPTION

Figure 1:
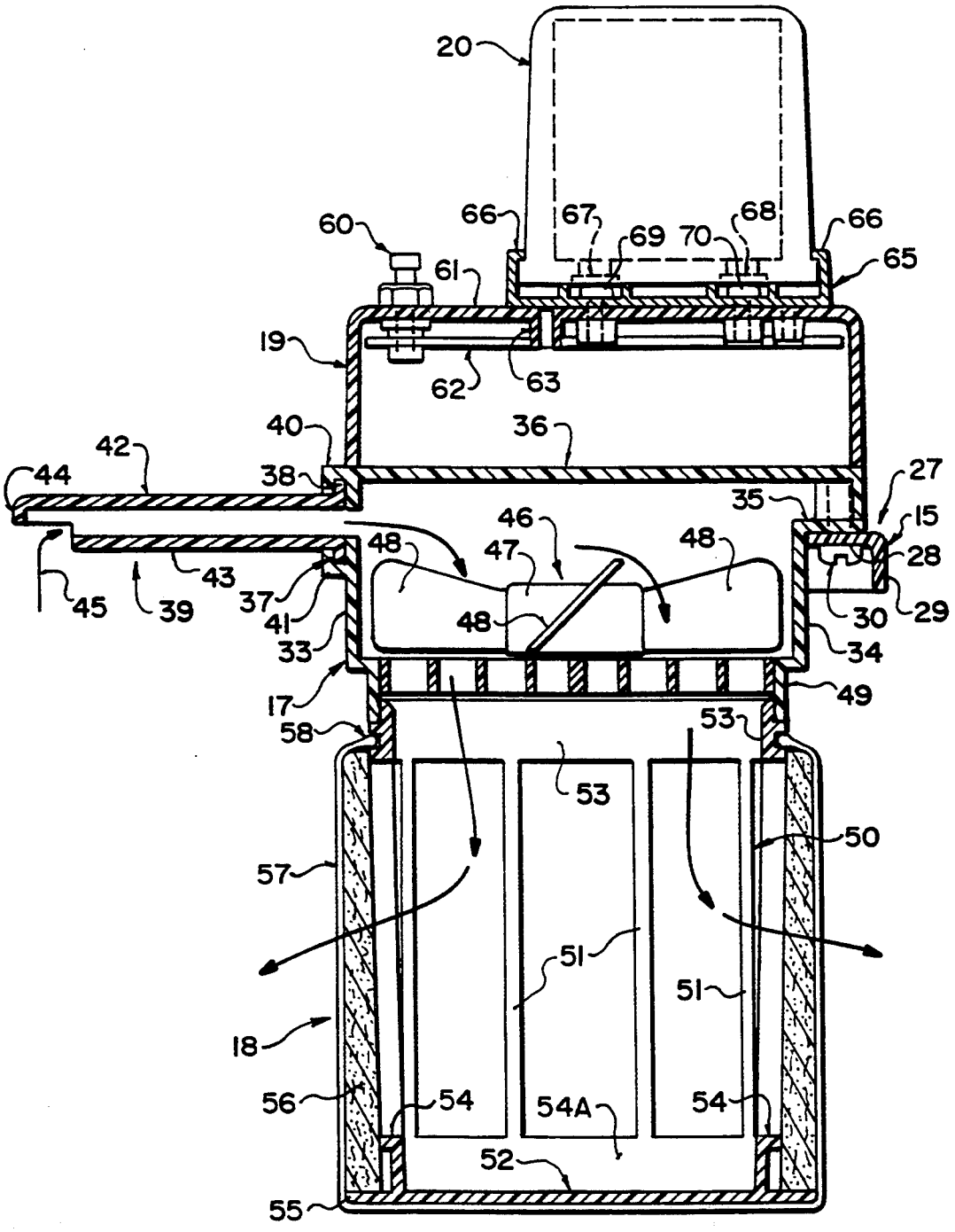
FIG. 1 is a vertical cross-sectional view through the filter and fan housing assembly of an air cleaning device according to the present invention, the cross-section being taken along the lines 1—1 of FIG. 4.
Figure 2:
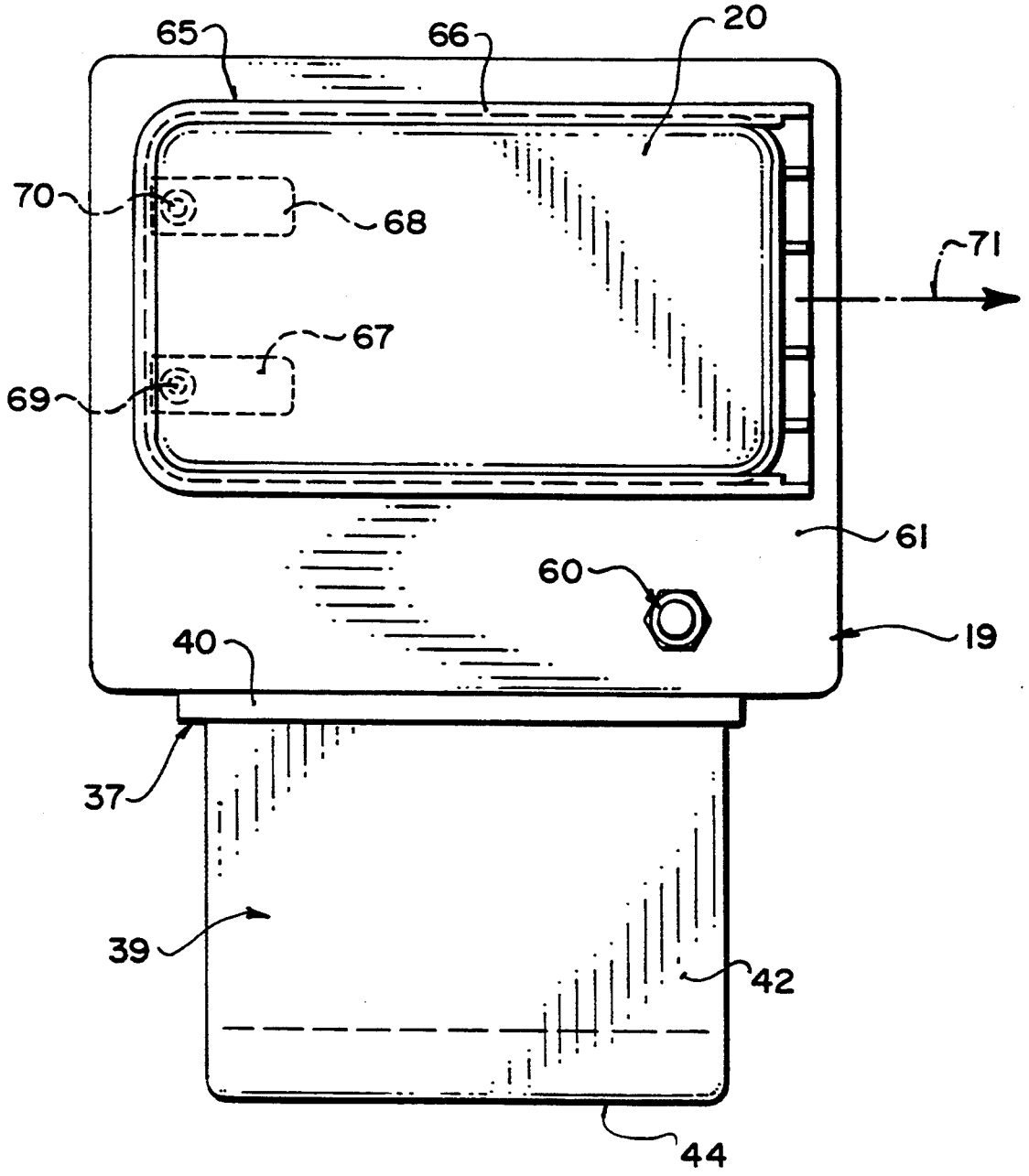
FIG. 2 is a top plan view of the fan and filter housing of FIG. 1.
Figure 3:
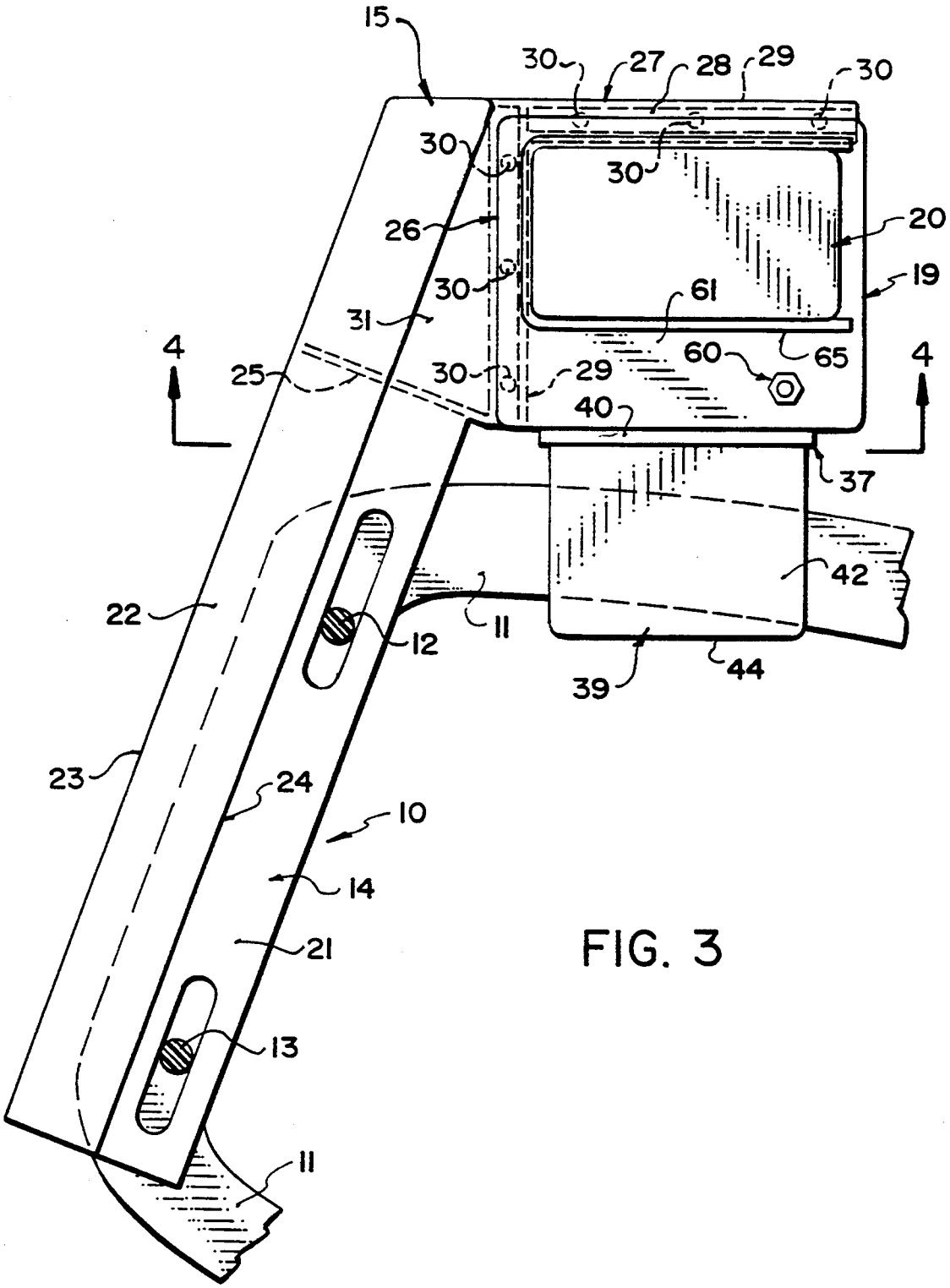
FIG. 3 is a similar top plan view that of FIG. 2 showing in addition a support bracket mounting the filter and fan housing in position on a toilet bowl.

The air cleaning device comprises a bracket generally indicated at 10 arranged for mounting on a toilet bowl

11 at the seat mounting bolts 12 and 13 of the toilet bowl. The bracket 10 includes a mounting portion 14 for attachment to the bowl and a cradle portion 15 integral with the mounting portion. Within the cradle portion 15 is mounted the fan and filter housing generally indicated at 16. This includes a fan housing section 17 and a filter section 18. On top of the fan housing section 17 is mounted an electrical compartment including a cover 19 on which is mounted a battery housing 20.

Figure 4:
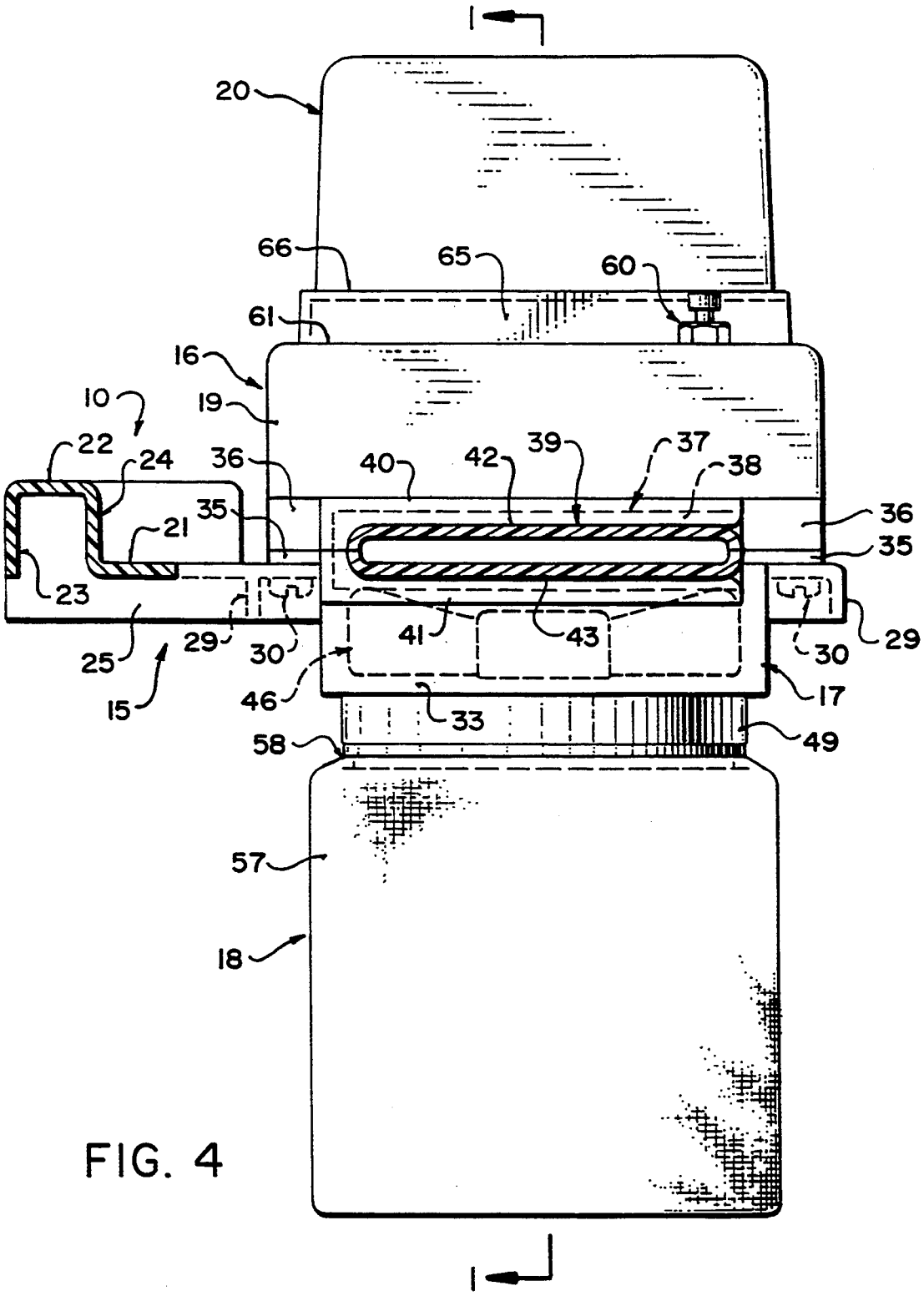
FIG. 4 is a cross-sectional view along the lines 4—4 of FIG. 3.

The bracket 10 comprises an elongate member of a substantially constant cross-section which is shown in FIG. 4 and includes a horizontal flange 21 for resting on the top face of the toilet bowl and a stiffener member 22 defined by vertical walls 23 and 24 and a horizontal top wall. The bottom edge or the vertical walls lies in the horizontal plane of the flange 21 so that the top wall is spaced above the horizontal flange. The stiffener member extends from the end of the flange 21 remote from the cradle portion 15 to the rear of the cradle portion at the rear part of the housing. The bracket is further stiffened by a transverse wall 25 across the junction between the bracket portion 14 and the cradle portion 15. The cradle portion comprises a first side 26 lying along side one side of the housing and a second side 27 at right angles to the side 26 so as to define the cradle on which the housing sits. Each of these sides 26 and 27 includes a horizontal web underlying a shoulder on the housing, the web being indicated at 28 and one or more vertical stiffening walls 29. The housing is fastened to the horizontal web 28 by a plurality of screws 30 which pass vertically upwardly through the web and into a threaded hole in the shoulder. The side 26 is connected to the stiffener member 22 by a horizontal flange portion 31.

The fan housing 17 comprises a substantially rectangular section with a vertical planar front wall 33, a vertical rear wall 34 parallel to the front wall and two side walls at right angles to the front and rear walls. The walls are connected at right angles and are integrally formed at their upper edge with a horizontal outwardly extending flange 35. The horizontal flange 35 defines the shoulder to which the horizontal web 28 of the cradle is attached. On top of the rectangular base part is mounted a rectangular top part 36 which is shaped in plan as a rectangle matching the outside edges of the flanges 35. The screws 30 extend through the flange 35 into a receptacle within top portion 36 so as to fasten those portions together and to fasten the housing to the cradle.

On the front face of the housing defined by the lower portion and the upper portion 36 is provided a slide receptacle 37 for receiving a flange 38 at a rear end of a suction nozzle 39. The slide receptacle 37 defines a slot between a pair of L-shaped members as best shown in FIG. 1, the upper L-shaped member being indicated at 40 and being mounted on the upper portion 36. A lower L-shape member 41 is provided on the bottom of the housing. The L-shape portions form a receptacle which is closed at the left hand end as shown in FIG. 4 and is open at the right hand end allowing the flange of the nozzle to slide in from the right hand end to a position received fully within the receptacle. Inside the receptacle is defined a transverse slot-shaped opening into the housing through which air can be drawn to enter into the upper part of the housing.

The nozzle 39 is formed in two portions including an upper portion 42 and a lower portion 43. Together these portions form a flat tube joined at a horizontal mid-line. The upper portion extends beyond the lower portion and includes a downturned end 44 thus tending to draw air upwardly and then inwardly into the flattened tube as indicated by the arrow 45.

Within the lower part of the fan housing is mounted a fan 46 having a central motor 47 the plurality of blades 48 extending radially outwardly from the motor. The blades are shaped so as to draw air axially downwardly of a vertical axis of the motor 47 so as to draw air vertically downwardly from the area above the fan and rearwardly of the slot-shaped opening from the nozzle and to propel that air downwardly to the bottom wall of the fan housing. The bottom wall of the fan housing includes a cylindrical wall 49 with an open face of the cylindrical wall facing downwardly.

Into the cylindrical wall is fastened the filter assembly 18. This comprises a cage 50 formed of a plurality of vertical bars 51 and a horizontal closed flat base 52. An upper edge of the bars is attached to a ring 53 which is snap fastened into the interior of the cylindrical wall 49 by way of interconnecting shoulders. The bars 51 define spaces between the bars to allow the escape of air. The bars at the lower end connect to a horizontal ring 53 which connects to a vertical ring 54 attached to the base plate 52 at a position thereon spaced inwardly from an outside edge 55 of the base plate. A cylindrical filter element 56 is positioned over the cage and sits on an upper surface of the base plate 52 outside the bars 51. A cylindrical filter element 56 is formed of a flexible porous material carrying an activated carbon filter for extracting gases from the air drawn by the fan into the filter housing. The filter housing thus has a hollow interior receiving the full volume of the air and the air must escape outwardly to the sides above the closed base plate 52 through the sleeve shaped filter 56. Around the sleeve shaped filter 56 is provided a fabric enclosure 57 with an elasticized top band 58 to hold the fabric enclosure in place over the whole of the cage including the underside of the base plate.

On top of a closed top wall of the upper housing portion 36 is mounted the cover 19 for the electrical compartment. The cover 19 carries a press button switch 60 of conventional type mounted on the top surface of the cover adjacent the front edge thereof. The cover is rectangular and includes a flat top surface 61 on which the switch 60 is mounted. Within the cover is provided an electrical component circuit board 62 mounted on pins 63 from the underside of the top wall 61. The switch communicates electrically with the components on the circuit board 62 and the circuit board communicates electrically with the motor of the fan to drive the fan as required. The circuit includes a timer for halting the action of the fan after a pre-set time period.

Electrical power to the device is provided by the battery pack 20 mounted in a receptacle 65 on the top surface of the cover 19. The battery pack 20 is substantially rectangular and includes a base flange allowing it to slide under side edges 66 of the receptacle. The battery pack includes a pair of terminals 67, 68 on the underside thereof which engage cooperating terminals 69, 70 on the top surface of the cover 61 within the receptacle 65. The battery pack can thus slide out of the receptacle in the direction of the arrow 71 to be removed from the receptacle for separate recharging. When recharged the battery pack can be simply inserted into the receptacle in a sliding action until the contacts engage providing electrical power to the system.

The design set forth above provides a simple effective air cleaning device which can be readily mounted onto a toilet bowl. The removable battery pack is conveniently located for ready removal and for recharging. The removable nozzle can also be readily removed for cleaning. The action of the fan directing air downwardly into the hollow interior of the cage defining the filter allows for a high flow rate of air through the filter to provide an effective cleaning action.

In an alternative arrangement (not shown) the battery pack can be omitted and electrical power supplied directly through an opening in the cover 19 from a suitable transformer providing low voltage power.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. An air cleaning device for mounting on a toilet bowl having a bowl opening, a bowl rim and a seat mounting on the rim rearwardly of the opening, the device comprising a bracket having a first portion arranged for mounting on the toilet bowl at the seat mounting, a second cradle portion projecting from the first portion outwardly to one side of the bowl, a flat nozzle member arranged to form an open slot shaped mouth for projecting over the rim and under the seat, the flat nozzle member including a flange at an end thereof and extending outwardly at right angles thereto;

a housing mounted on the cradle portion so as to be located to one side of the rim and being substantially rectangular including a front face facing toward the rim, a rear face parallel to the front face, a pair of side faces generally at right angles to the front face, and a lower surface facing downwardly toward the floor having a cylindrical wall portion of circular cross-section with an outlet opening being arranged at a bottom of the cylindrical wall portion;

a slide receptacle is provided on the front face of the housing for receiving the flange at the rear end of the flat nozzle, said slide receptacle defining a slot between a pair of L-shaped members, an upper L-shaped member and a lower L-shape member, the slide receptacle being closed at one end and open at the other, inside said receptacle being defined a horizontal elongate slot-shaped inlet opening into the housing;

a fan and motor mounted in the housing above the lower surface;

a filter support cage mounted on the housing at the outlet opening extending downwardly, having a plurality of vertical bars annularly spaced apart defining a cylindrical outer surface and a hollow interior, having at a lower end of the vertical bars a horizontal ring which connects to a vertical ring below, the vertical ring being attached to a closed horizontal base plate at a position thereon spaced inwardly from an outside edge of the horizontal base plate forming a flange extending outwardly beyond the vertical bars and defining a lower surface on which the sleeve shaped filter member sits, and having at an upper end of the vertical bars an upper ring and interlocking fastening means for connecting to the housing;

the interlocking fastening means being snap fasteners comprising shoulders on the upper ring of the filter support cage extending upwards for engaging shoulders on the interior of the cylindrical wall portion of the housing;

a sleeve shaped flexible filter member engaged over the filter support cage including a cylindrical filter element for positioning over the filter support cage and sitting on an upper surface of the horizontal base plate outside the vertical bars, and wherein the filter element is formed of a flexible porous material carrying an activated carbon filter, the sleeve shaped filter having a fabric enclosure with a top band to hold said fabric enclosure in place over the whole of the filter support cage including the underside of the horizontal base plate;

the housing and fan being arranged such that air drawn by the fan into the mouth of the nozzle is expelled from the housing into the hollow interior of the cage and through the filter member.

2. The device according to claim 1 wherein the rectangular housing includes a fan housing section and separate cover member defining a cavity above the fan housing for receiving an electronics control board.

3. The device according to claim 2 wherein the fan housing is formed in two pieces separable at the first opening.

4. The device according claim 1 wherein the housing includes a horizontal lower surface portion surrounding at least part thereof and engageable with the cradle portion.

5. The device according to claim 4 wherein the housing includes a portion thereof standing upwardly from the cradle portion.

6. An air cleaning device for mounting on a toilet bowl having a bowl opening, a bowl rim and a seat mounting on the rim rearwardly of the opening, the device comprising a bracket having a first portion arranged for mounting on the toilet bowl at the seat mounting, a second cradle portion projecting from the first portion outwardly to one side of the bowl, a flat nozzle member arranged to form an open slot shaped mouth for projecting over the rim and under the seat, the flat nozzle member including a flange at an end thereof and extending outwardly at right angles thereto;

a housing mounted on the cradle portion so as to be located to one side of the rim and being substantially rectangular including a front face facing toward the rim, a rear face parallel to the front face, a pair of side faces generally at right angles to the front face, and a lower surface facing downwardly toward the floor having a cylindrical wall portion of circular cross-section with an outlet opening being arranged at a bottom of the cylindrical wall portion;

a slide receptacle is provided on the front face of the housing for receiving the flange at the rear end of the flat nozzle, said slide receptacle defining a slot between a pair of L-shaped members, an upper L-shaped member and a lower L-shape member, the slide receptacle being closed at one end and open at the other, inside said receptacle being defined a horizontal elongate slot-shaped inlet opening into the housing;

a fan and motor mounted in the housing above the lower surface;

a rechargeable battery pack mounted in a receptacle on a top surface of the housing, said battery pack being substantially rectangular and including a base flange allowing it to slide under side edges of the receptacle, and including a pair of terminals on the underside thereof which engage cooperating terminals on the top surface of the cover within the receptacle;

a filter support cage mounted on the housing at the outlet opening extending downwardly, having a plurality of vertical bars annularly spaced apart defining a cylindrical outer surface and a hollow interior, having at a lower end of the vertical bars a horizontal ring which connects to a vertical ring below, the vertical ring being attached to the closed horizontal base plate at a position thereon spaced inwardly from an outside edge of the horizontal base plate forming a flange extending outwardly beyond the vertical bars and defining a lower surface on which the sleeve shaped filter member sits, and having at an upper end of the vertical bars an upper ring and interlocking fastening means for connecting to the housing;

the interlocking fastening means being snap fasteners comprising shoulders on the upper ring of the filter support cage extending upwards for engaging shoulders on the interior of the cylindrical wall portion of the housing;

a sleeve shaped flexible filter member engaged over the filter support cage including a cylindrical filter element for positioning over the filter support cage and sitting on an upper surface of the horizontal base plate outside the vertical bars, and wherein the filter element is formed of a flexible porous material carrying an activated carbon filter, the sleeve shaped filter having a fabric enclosure with a top band to hold said fabric enclosure in place over the whole of the filter support cage including the underside of the horizontal base plate;

the housing and fan being arranged such that air drawn by the fan into the mouth of the nozzle is expelled from the housing into the hollow interior of the cage and through the filter member.

7. The device according to claim 6 wherein the rectangular housing includes a fan housing section and separate cover member defining a cavity above the fan housing for receiving an electronics control board.

8. The device according to claim 7 wherein the fan housing is formed in two pieces separable at the first opening.

9. The device according claim 6 wherein the housing includes a horizontal lower surface portion surrounding at least part thereof and engageable with the cradle portion.

10. The device according to claim 9 wherein the housing includes a portion thereof standing upwardly from the cradle portion.

* * * * *